US007353734B1

(12) United States Patent
Hu

(10) Patent No.: US 7,353,734 B1
(45) Date of Patent: Apr. 8, 2008

(54) SCREWDRIVER HAVING A RATCHET MECHANISM

(76) Inventor: Cheng-Tsan Hu, No. 205, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 0 days.

(21) Appl. No.: 11/675,923

(22) Filed: Feb. 16, 2007

(51) Int. Cl.
*B25B 13/46* (2006.01)

(52) U.S. Cl. ..... 81/62; 81/63.1

(58) Field of Classification Search ..... 81/60–62, 81/63.1; 192/43.1, 43.2
See application file for complete search history.

(56) References Cited

U.S. PATENT DOCUMENTS 6,260,446 B1 * 7/2001 Hu ..... 81/62
6,644,147 B1 * 11/2003 Huang ..... 81/62
6,928,908 B1 * 8/2005 Yu ..... 81/490
7,185,565 B1 * 3/2007 Hu ..... 81/62
7,290,465 B2 * 11/2007 Gao et al. ..... 81/62
2002/0043134 A1 * 4/2002 Ho ..... 81/60
2003/0110901 A1 * 6/2003 Shiao ..... 81/62
2006/0225537 A1 * 10/2006 Shiao ..... 81/62
2007/0012142 A1 * 1/2007 Shiao ..... 81/62

* cited by examiner

*Primary Examiner*—D S Meislin
(74) *Attorney, Agent, or Firm*—WPAT, PC

(57) ABSTRACT

A screwdriver having a ratchet mechanism includes a handle and a switch assembly. A ratchet base is provided in the handle. The ratchet base is provided with a locating device. The switch assembly is pivotally connected to the handle. A locating plate extends from the edge of the switch assembly and corresponds in position to the locating device of the ratchet base. The locating plate has recesses for the locating device to be secured thereat. The screwdriver can be operated accurately to change the turning direction of a tool sleeve and to replace and secure a tool head in position.

5 Claims, 7 Drawing Sheets

SCREWDRIVER HAVING A RATCHET MECHANISM

BACKGROUND OF THE INVENTION

1. Field of the Invention

The present invention relates to a screwdriver having a ratchet mechanism, in particular to a ratchet mechanism provided in a rear portion of a handle to change the turning direction of a tool sleeve and to replace a tool head accurately.

2. Description of the Prior Art

There are various ratchet hand tools on the market. Each has its special function, such as U.S. Pat. No. 5,875,693 which uses a gear to secure and to change the turning direction. The gear may get damaged easily, causing meshing inappropriately.

A ratchet mechanism for a screwdriver, such as U.S. Pat. Nos. 6,070,503, 6,253,654 and 6,854,363, is provided at a front portion or at a front end of a handle, which may accidentally touch an adjusting switch when operating the screwdriver.

In addition, a conventional screwdriver has the parts assembled in an axial direction, and is provided with a knob to change the direction. This design has a locating device to do the adjustment. The locating direction of the locating device is parallel to the assembled direction of the screwdriver. It is difficult to adjust the locating device.

SUMMARY OF THE INVENTION

It is the primary objective of the present invention to provide a screwdriver having a ratchet mechanism, which can be operated accurately to change the turning direction of a tool sleeve.

It is another objective of the present invention to provide a screwdriver having a ratchet mechanism, which is not easy to be worn out and can last longer.

It is a further objective of the present invention to provide a screwdriver having a ratchet mechanism, which provides an accurate position.

According to the present invention, there is provided a screwdriver having a ratchet mechanism comprising a tool sleeve provided with a ratchet head, said ratchet head having ratchet teeth; a handle comprising a hollow chamber to accommodate said tool sleeve and a ratchet base, said ratchet base comprising a compartment, first and second recesses and a locating device, said first and second recesses interconnecting with said compartment, said compartment accommodating said ratchet head and said ratchet teeth, said locating device being disposed at an outer side of said ratchet base; a first detent accommodated in said first recess of said ratchet base of said handle, said first detent comprising a stud to be connected to said ratchet base; a first elastic element disposed in said first recess and engaging with said first detent and said ratchet base, urging said first detent to engage with said ratchet teeth of said ratchet head; a second detent accommodated in said second recess of said ratchet base of said handle, said second detent comprising a stud to be connected to said ratchet base; a second elastic element disposed in said second recess and engaging with said second detent and said ratchet base, urging said second detent to engage with said ratchet teeth of said ratchet head; and a switch assembly comprising a through hole, a fastener, a first stud, a second stud and a locating plate, said ratchet head being inserted through said through hole and pivotally connected to said handle by means of said fastener, said first stud engaging with said first detent, said second stud engaging with said second detent, said locating plate extending from the edge of said switch assembly and corresponding in position to said locating device of said ratchet base, said locating plate having recesses for securing said locating device.

DETAILED DESCRIPTION OF THE PREFERRED EMBODIMENT

Figure 1:
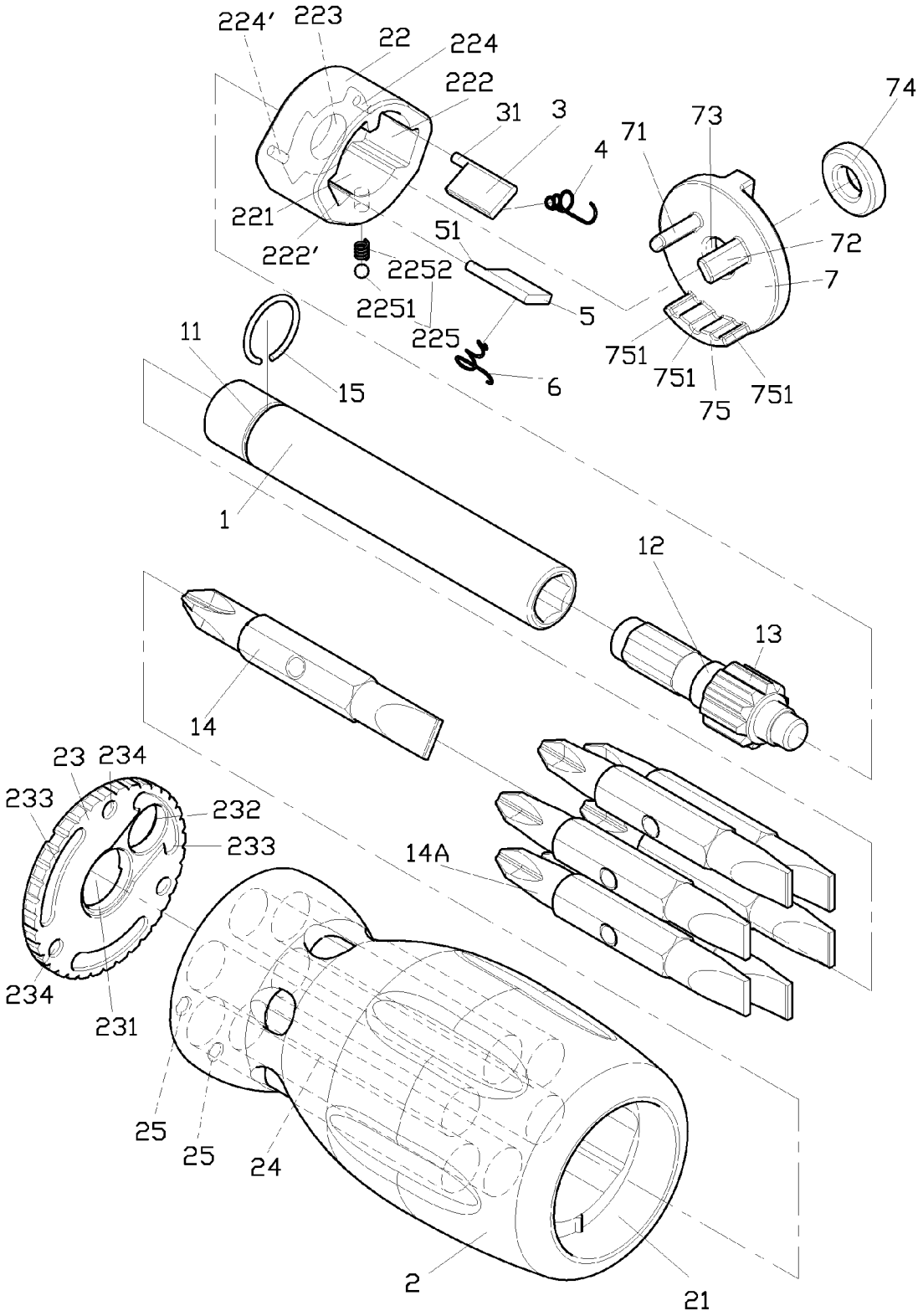
FIG. 1 is an exploded view of a preferred embodiment of the present invention.
Figure 2:
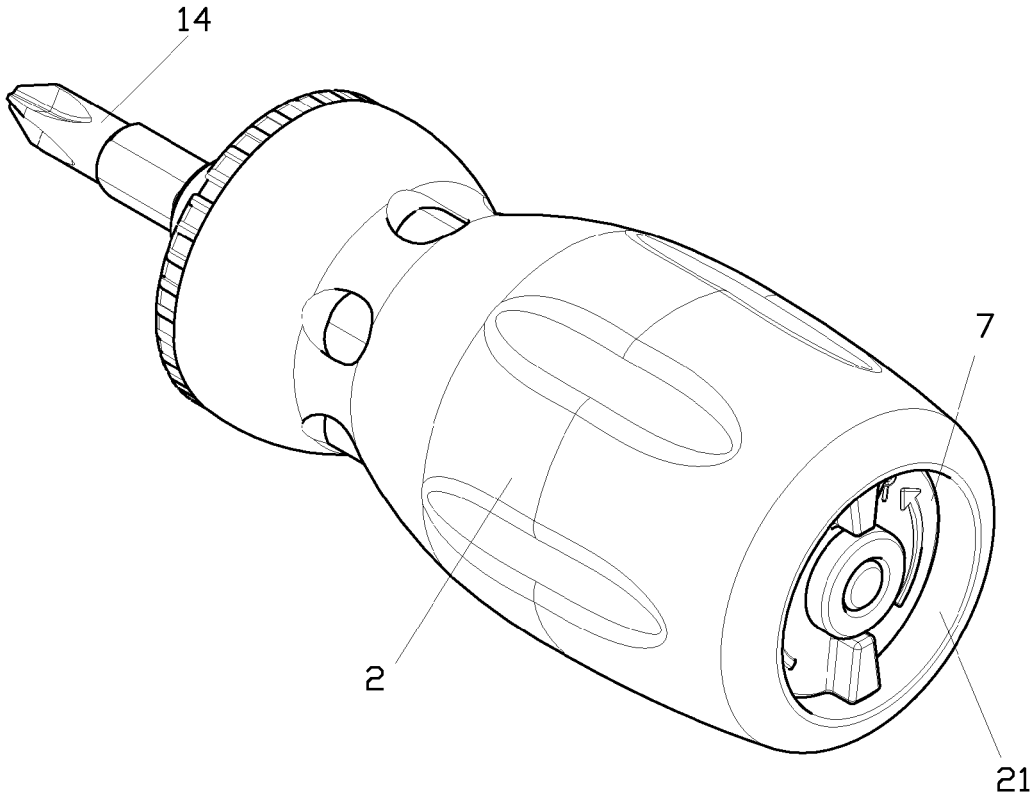
FIG. 2 is a perspective view of the preferred embodiment of the present invention.

As shown in FIGS. 1 and 2, a preferred embodiment of the present invention comprises a tool sleeve 1, a handle 2, a first detent 3, a first elastic element 4, a second detent 5, a second elastic element 6, and a switch assembly 7.

The tool sleeve 1 comprises a groove 11 at a front portion and a ratchet head 12 at a rear end thereof. The tool sleeve 1 has a front end to receive a tool head 14 therein. The ratchet head 12 is formed with ratchet teeth 13 on its outer surface. The tool sleeve 1 may be coupled with other tool heads 14A stored in the handle 2, and a C-shaped fastener 15 is provided on the tool sleeve 1.

The handle 2 comprises a hollow chamber 21 therein. The tool sleeve 1 is accommodated in a front portion of the chamber 21. A ratchet base 22 is provided in a rear portion of the chamber 21. The ratchet base 22 comprises a compartment 221, a first recess 222, a second recess 222', an aperture 223, a first hole 224 and a second hole 224'. The compartment 221 interconnects with the first recess 222 and the second recess 222'. The aperture 223, the first hole 224 and the second hole 224' are disposed at the bottom of the ratchet base 22. The ratchet head 12 with the ratchet teeth 13 is accommodated in the compartment 221. The tool sleeve 1 is inserted through the aperture 223. The handle 2 further comprises a disc 23 which is pivotally connected to the tool sleeve 1 and secured by the fastener 15 to confine its movement. The disc 23 comprises a through hole 231 and an opening 232. The through hole 231 is for the tool sleeve 1 to extend through. The handle 2 further comprises a plurality of cavities 24 to accommodate tool heads 14A. The opening 232 is to replace the tool heads 14A. A locating device 225 is provided at an outer side of the ratchet base 22. The locating device 225 comprises a bearing 2251 and an elastic element 2252 which urges the bearing 2251 inwardly. The handle 2 further comprises protuberances 25. The disc 23 is formed with arc troughs 233 and holes 234 for insertion of the protuberances 25. There are at least two cavities 24 equally spaced from each other in the handle 2. The center of each arc trough 233 and the center of each hole 234 are also equally spaced from each other so as to correspond in position to the cavities 24 of the handle 2.

The first detent 3 is a plate and accommodated in the first recess 222 of the ratchet base 22 of the handle 2. The first detent 3 comprises a stud 31 to be inserted into the hole 224 of the ratchet base 22.

The first elastic element 4 is located in the recess 222 between the first detent 3 and the ratchet base 22, urging the first detent 3 to engage with the ratchet teeth 13 of the ratchet head 12.

The second detent 5 is a plate and accommodated in the recess 222' of the ratchet base 22 of the handle 2. The detent 5 comprises a stud 51 to be inserted into the hole 224' of the ratchet base 22.

The second elastic element 6 is located in the recess 222' between the second detent 5 and the ratchet base 22, urging the second detent 5 to engage with the ratchet teeth 13 of the ratchet head 12.

The switch assembly 7 is secured to the tool sleeve 1 and pivotally connected to the handle 2. The switch assembly 7 comprises a first stud 71, a second stud 72, a through hole 73, a fastener 74 and a locating plate 75. The locating plate 75 extends from the edge of the switch assembly 7 and corresponds in position to the locating device 225 of the ratchet base 22. The locating plate 75 has recesses 751 for the locating device 225 to be secured thereat. The through hole 71 is for the tool sleeve 1 to be inserted therethrough, and the fastener 74 is secured to the tool sleeve 1. The first stud 71 engages with the first detent 3, and the second stud 72 engages with the second detent 5.

The tool sleeve 1, the ratchet base 22, the ratchet head 12 and the switch assembly 7 are accommodated in the handle 2 in sequence. The first detent 3, the first elastic element 4, the second detent 5, and the second elastic element 6 are accommodated in the ratchet base 22. The first detent 3 and the second detent 5 engage with the ratchet teeth 13 of the ratchet head 12, respectively. By adjusting the first stud 71 and the second stud 72 of the switch assembly 7 to engage with and to link the first detent 3 and the second detent 5, respectively, the turning direction of the tool sleeve 1 is able to change.

Figure 3:
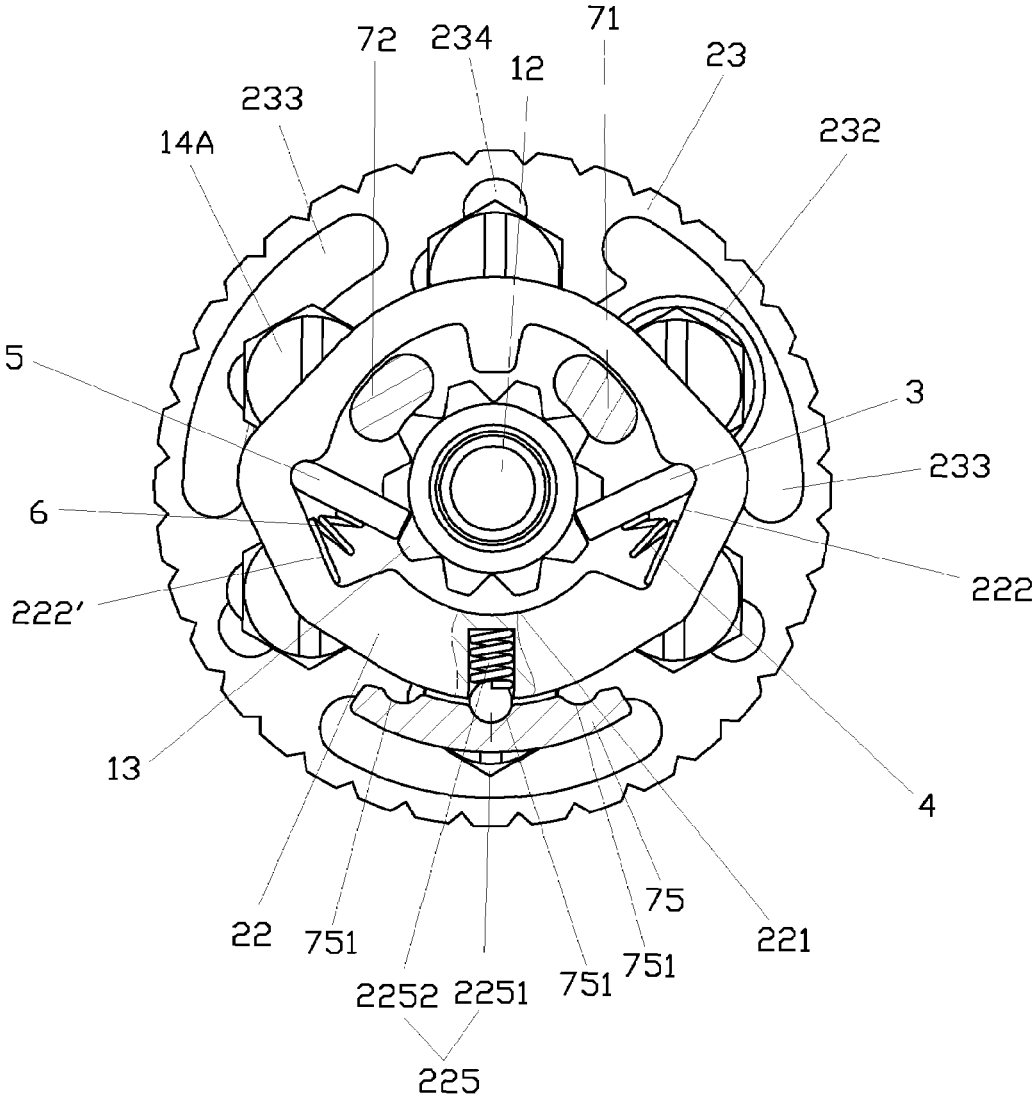
FIG. 3 is a cross-sectional view of the preferred embodiment of the present invention in a two-way engagement status.

FIG. 3 shows two-way engagement of the present invention. When the switch assembly 7 is located at the center, both the first detent 3 and the second detent 5 are engaged with the ratchet teeth 13 of the ratchet head 12. The first stud 71 and the second stud 72 are disengaged from the first detent 3 and the second detent 5, thus the tool head 14A is direct linked with the handle 2.

Figure 4:
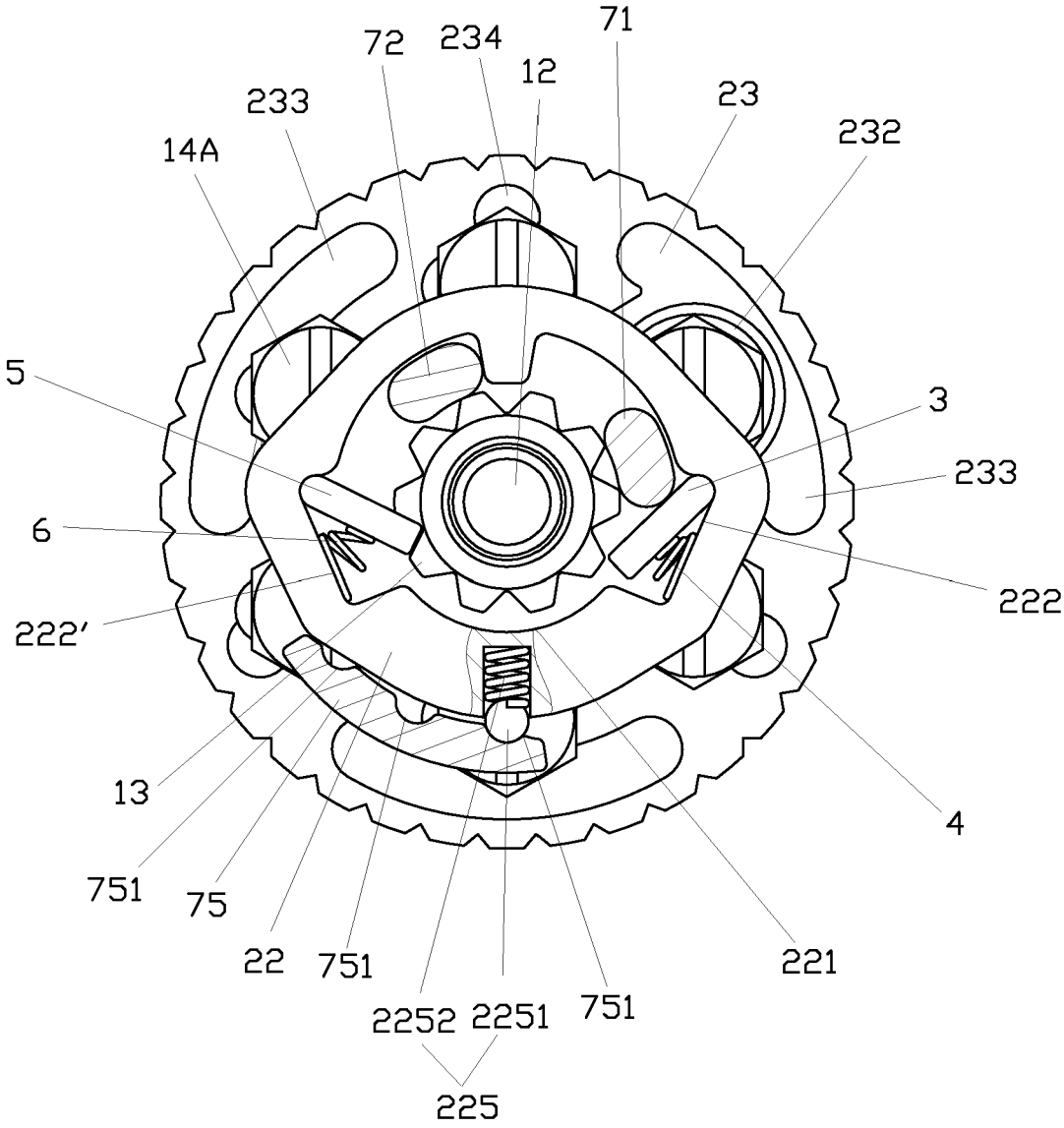
FIG. 4 is a cross-sectional view of the preferred embodiment the present invention in a clockwise engagement status.
Figure 5:
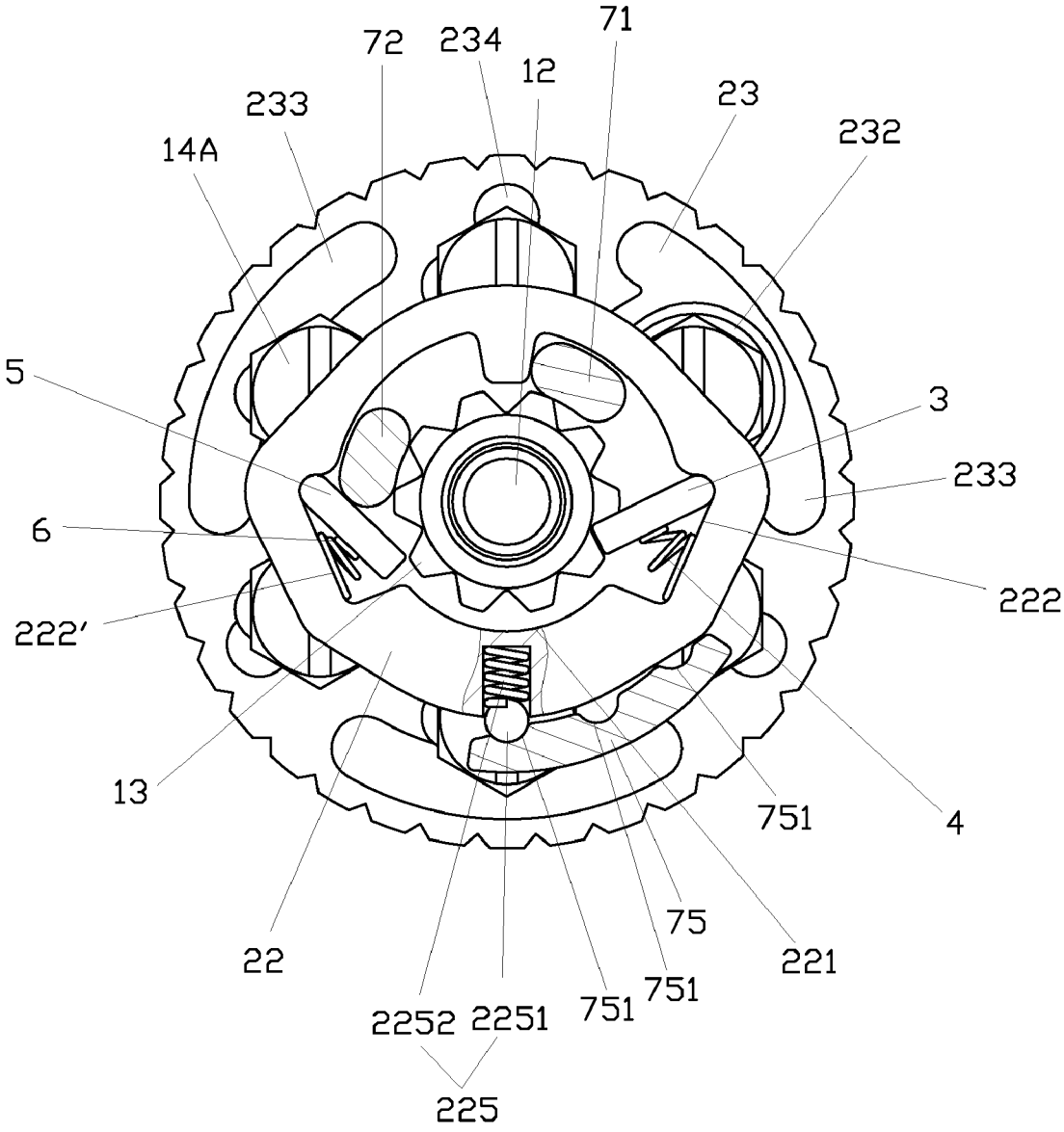
FIG. 5 is a cross-sectional view of the preferred embodiment the present invention in a counterclockwise engagement status.

As shown in FIGS. 4 and 5, the turning direction of the operation of the present invention is changed. FIG. 4 shows a clockwise turning direction. FIG. 5 shows a counterclockwise turning direction. When the switch assembly 7 is pushed towards one side, either of the first stud 71 and the second stud 72 will link the first detent 3 or the second detent 5 to be retreated from the ratchet teeth 13 of the ratchet head 12, thus the turning direction of the tool sleeve 1 is able to change towards the direction as desired.

Figure 6:
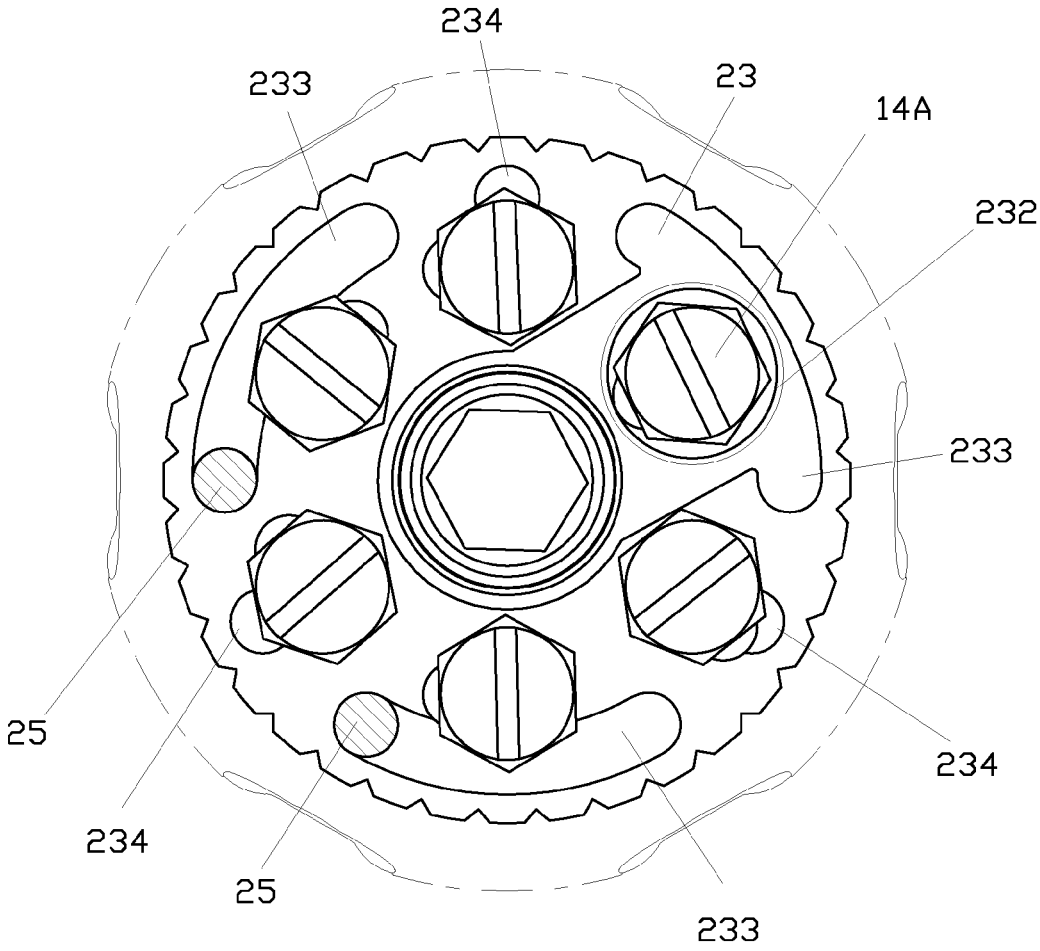
FIG. 6 is a cross-sectional view of the preferred embodiment of the present invention showing that an opening of a disc is turned to align with a cavity.

As shown in FIG. 6, when the disc 23 is turned to align the opening 232 with one of the cavities 24, the protuberances 25 will be engaged with respective ends of the arc trough 233 provided with the opening 232, thus a desired tool head 14A may be picked up from the cavity 24, and the other tool heads 14A may be placed back into the cavities 24 through the opening 232.

Figure 7:
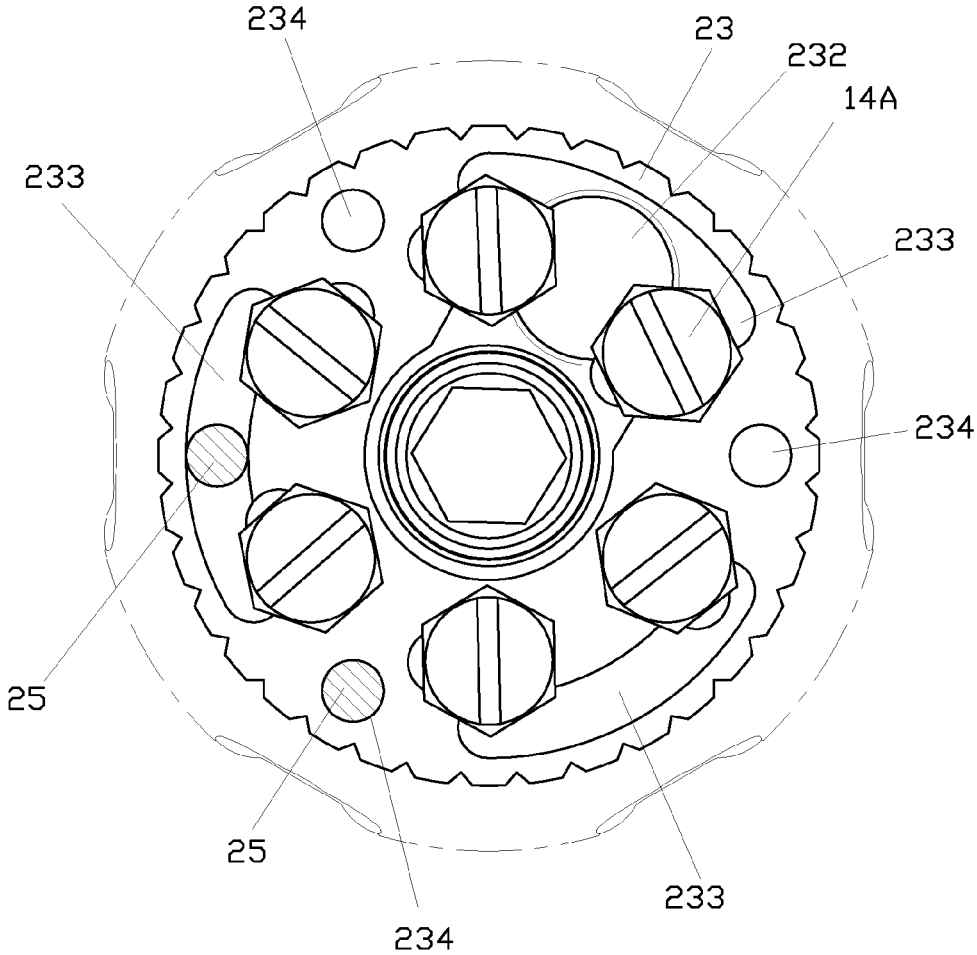
FIG. 7 is a cross-sectional view of the preferred embodiment of the present invention showing that the disc is turned to close the cavity.

As shown in FIG. 7, when the disc 23 is turned to close the cavities 24, the opening 23 and the cavities 24 are in a staggered status. One of the protuberances 25 is located in one of the holes 234, while the other of the protuberance 25 is located in the center of the arc trough 233 to secure the disc 23 in place and to block the tool heads 14A within the cavities 24.

What is claimed is:

1. A screwdriver having a ratchet mechanism comprising:

a tool sleeve provided with a ratchet head, said ratchet head having ratchet teeth;

a handle comprising a hollow chamber to accommodate said tool sleeve and a ratchet base, said ratchet base comprising a compartment, first and second recesses and a locating device, said first and second recesses interconnecting with said compartment, said compartment accommodating said ratchet head and said ratchet teeth, said locating device being disposed at an outer side of said ratchet base;

a first detent accommodated in said first recess of said ratchet base of said handle, said first detent comprising a stud to be connected to said ratchet base;

a first elastic element disposed in said first recess and engaging with said first detent and said ratchet base, urging said first detent to engage with said ratchet teeth of said ratchet head;

a second detent accommodated in said second recess of said ratchet base of said handle, said second detent comprising a stud to be connected to said ratchet base;

a second elastic element disposed in said second recess and engaging with said second detent and said ratchet base, urging said second detent to engage with said ratchet teeth of said ratchet head; and a switch assembly comprising a through hole, a fastener, a first stud, a second stud and a locating plate, said ratchet head being inserted through said through hole and pivotally connected to said handle by means of said fastener, said first stud engaging with said first detent, said second stud engaging with said second detent, said locating plate extending from the edge of said switch assembly and corresponding in position to said locating device of said ratchet base, said locating plate having recesses for securing said locating device.

2. The screwdriver having a ratchet mechanism, as recited in claim 1, wherein said locating device comprises a bearing and an elastic element, said elastic element urging said bearing to engage with said locating plate.

3. The screwdriver having a ratchet mechanism, as recited in claim 1, wherein said handle further comprises a disc and cavities to accommodate tool heads, said disc having an opening corresponding to said cavities.

4. The screwdriver having a ratchet mechanism, as recited in claim 3, wherein said handle further comprises protuberances and said disc comprises arc troughs and holes for insertion of said protuberances.

5. The screwdriver having a ratchet mechanism, as recited in claim 4, said handle comprises at least two equally spaced cavities and said arc troughs and said holes of said disc are equally spaced from each other, said opening of said disc being disposed in one of said arc troughs.

* * * * *